United States Patent [19]

Panetski et al.

[11] Patent Number: 5,042,366

[45] Date of Patent: Aug. 27, 1991

[54] DECORATIVE AIR TEMPERATURE EQUALIZING COLUMN FOR ROOM

[76] Inventors: Judith A. Panetski; Stanley K. Panetski, both of 49 Cottage St., Buffalo, N.Y. 14201

[21] Appl. No.: 518,148

[22] Filed: May 3, 1990

[51] Int. Cl.[5] ..... F24F 7/007

[52] U.S. Cl. ..... 98/31.5; 98/40.19

[58] Field of Search ..... 98/31.5, 40.19, 31.6, 98/32

[56] References Cited

U.S. PATENT DOCUMENTS

| | | | |
|---|---|---|---|
| 3,173,353 | 3/1965 | Watkins | 98/31.5 |
| 3,827,342 | 8/1974 | Hughes | 98/31.5 |
| 4,136,606 | 1/1979 | Wolbrink | 98/31.5 |
| 4,184,415 | 1/1980 | Nicholson | 98/31.5 |
| 4,185,545 | 1/1980 | Rusth et al. | 98/31.5 |
| 4,852,470 | 8/1989 | Corriveau | 98/40.19 |
| 4,945,820 | 8/1990 | Fukuda | 98/31.5 |
| 4,950,871 | 8/1990 | Pollack et al. | 98/31.5 |

*Primary Examiner*—Albert J. Makay
*Assistant Examiner*—William C. Doerrles
*Attorney, Agent, or Firm*—Joseph P. Gastel

[57] ABSTRACT

A decorative air temperature equalizing column for placement in a room and circulating air from the upper portion of the room to the lower portion thereof including a hollow columnar member, an air inlet in the upper portion of the columnar member, an air outlet in the lower portion of the columnar member, and a fan in the columnar member for moving warm air from the upper portion of the room into the lower portion thereof.

16 Claims, 3 Drawing Sheets

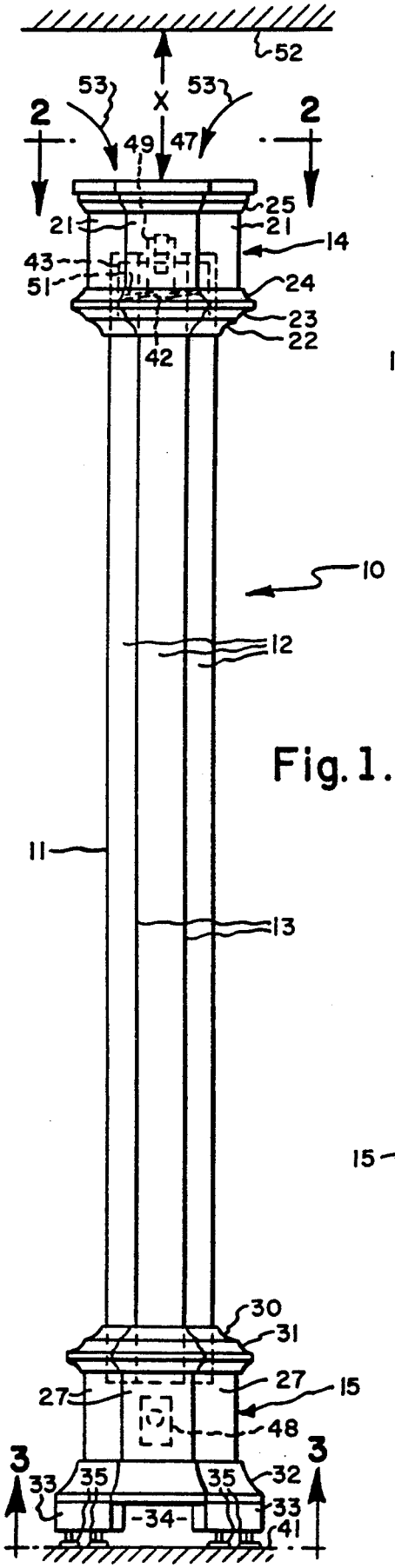
Fig. 1.
Fig. 2.
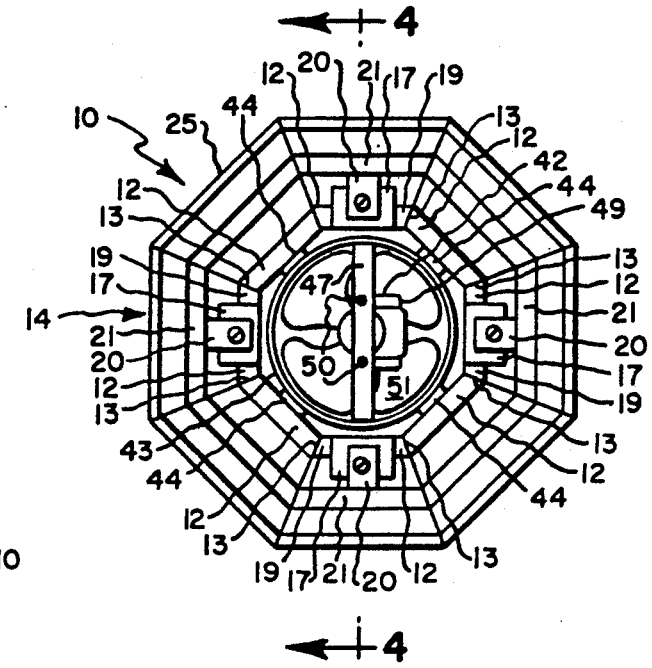
Fig. 3.
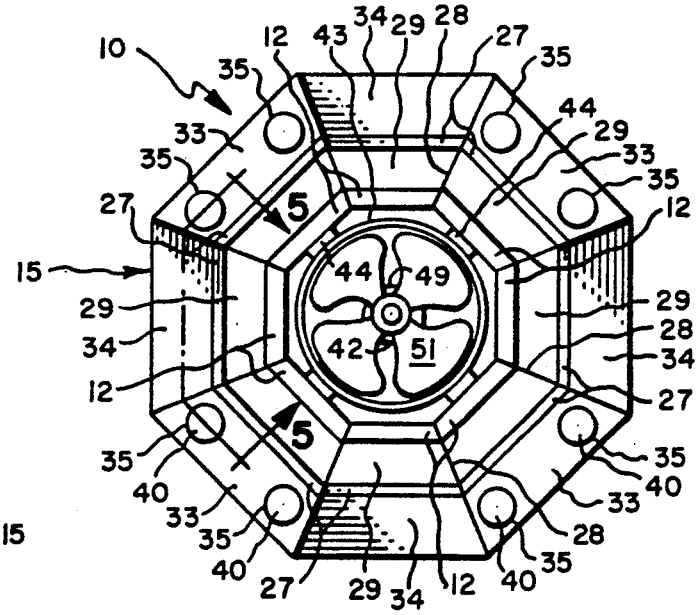

Fig. 4.
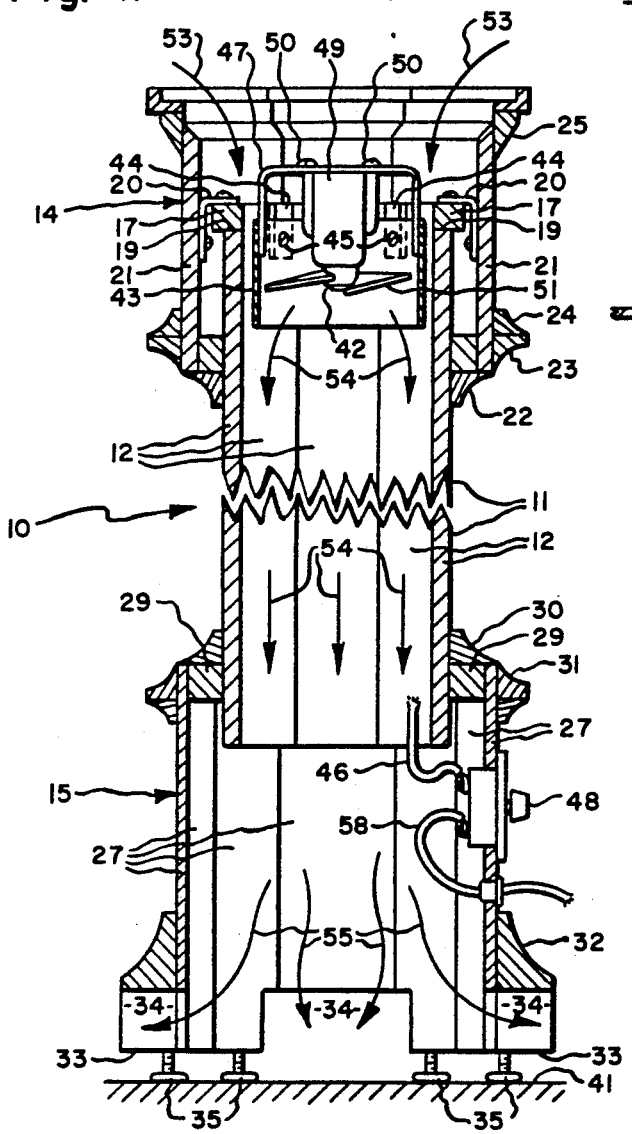
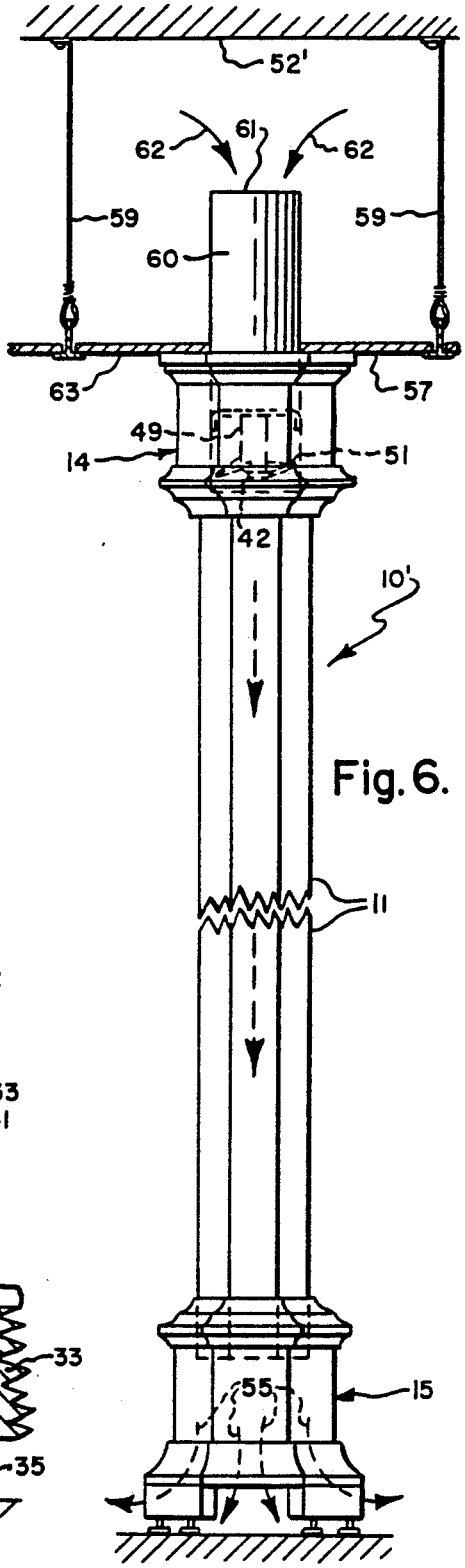
Fig. 6.
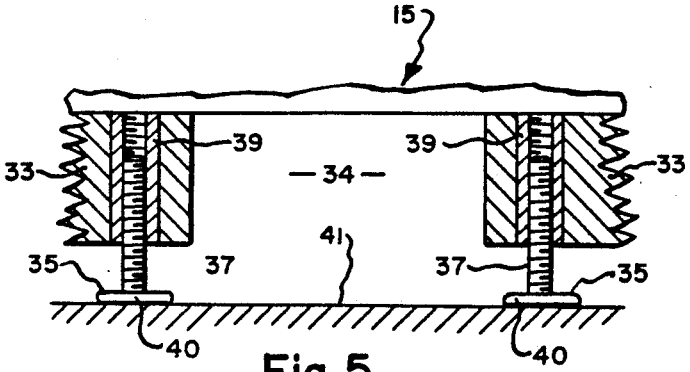
Fig. 5.

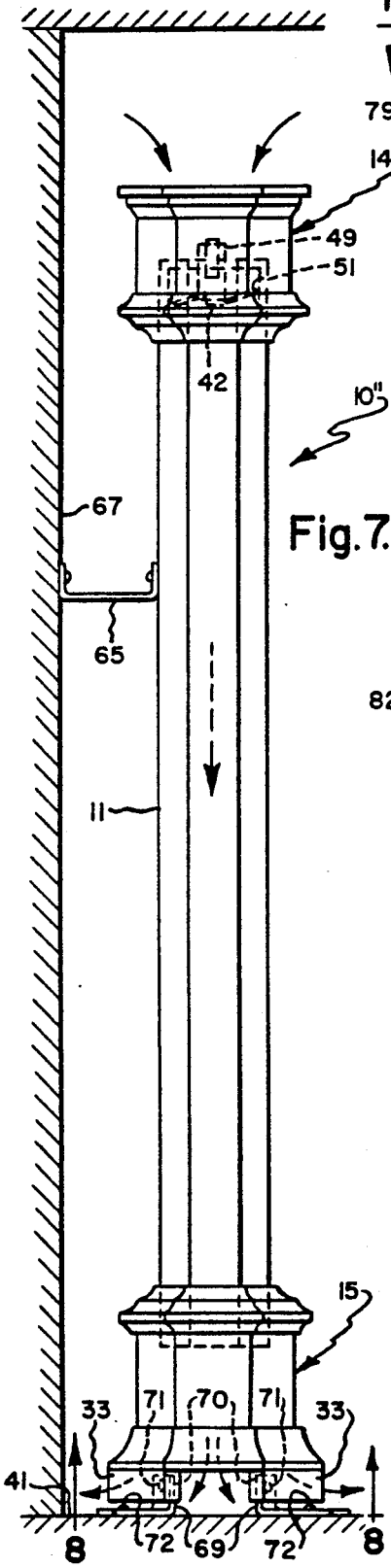
Fig.7.
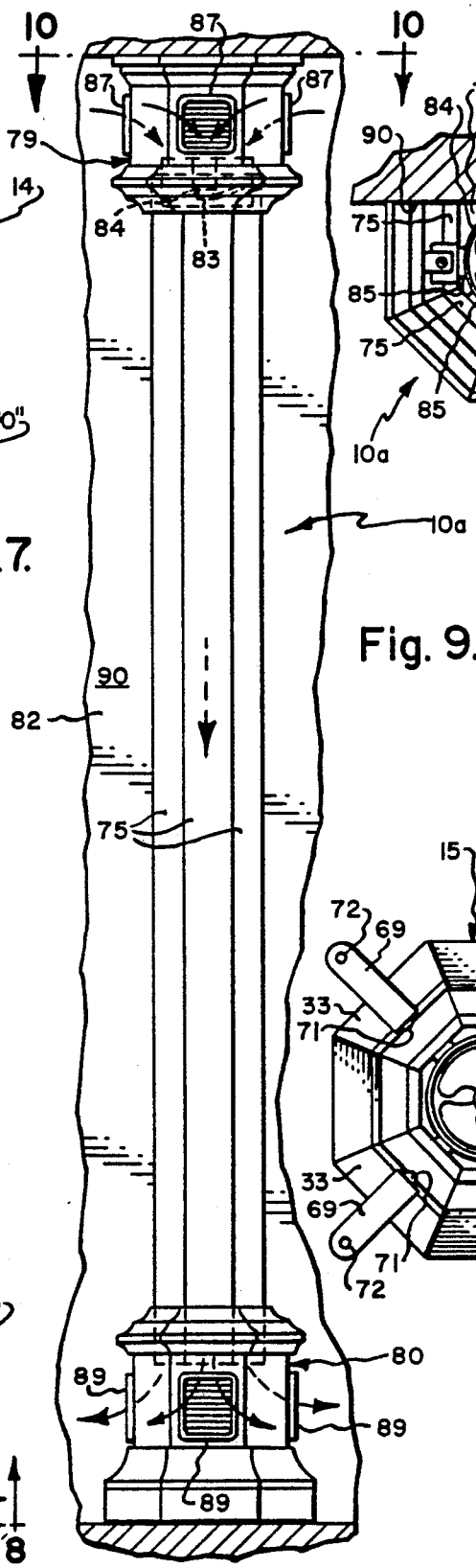
Fig. 9.
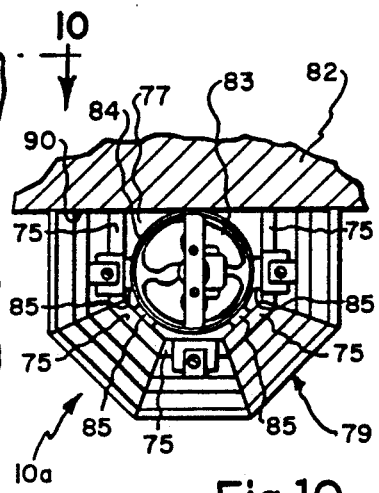
Fig.10.
Fig. 8.
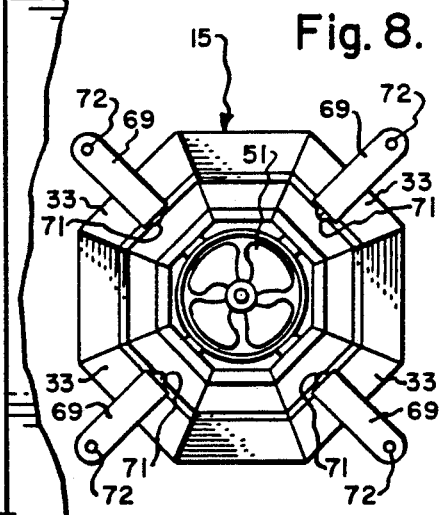

DECORATIVE AIR TEMPERATURE EQUALIZING COLUMN FOR ROOM

BACKGROUND OF THE INVENTION

The present invention relates to a decorative air temperature equalizing column for placement in a room and circulating air from the upper portion of the room to the lower portion thereof to thereby not only conserve heat but also provide a decorative accent to a room.

By way of background, in the winter, warm air tends to stratify in the upper portions of a room while cool air remains in the lower portion. In the past, ceiling fans have been utilized to circulate the air and thus tend to move the upper warm air into the lower portion of a room. However, ceiling fans required special installations and mountings. In addition, depending on the speed at which they operated, they usually produced air currents which could be objectionable.

SUMMARY OF THE INVENTION

It is one object of the present invention to provide a decorative air temperature equalizing column which can be placed as a decorative accent to a room and which will circulate warm upper room air into the lower portion thereof, thereby tending to equalize the room air temperature.

Another object of the present invention is to provide a decorative air temperature equalizing column which can be positioned, as desired, in various portions of a room without requiring any specific type of electrical installation other than plugging it into an electrical wall outlet.

A further object of the present invention is to provide a decorative temperature air equalizing column which can be installed relative to dropped ceilings and which can conduct warm air which is trapped above the ceiling into the lower portion of the room.

Yet another object of the present invention is to provide an air temperature equalizing column which can be mounted on the wall for conducting warm air from the upper portion of the room to the lower portion of the room. Other objects and attendant advantages of the present invention will readily be perceived hereafter.

The present invention relates to a decorative air temperature equalizing column for placement in a room and circulating air from the upper portion of the room to the lower portion thereof comprising a hollow columnar member, an upper column portion in said columnar member, a lower column portion in said columnar member, air inlet means in said upper column portion, air outlet means in said lower column portion, and air moving means in said columnar member for causing flow of air from said upper portion of said room into said air inlet means and through said columnar member and out of said air outlet means into said lower portion of said room to thereby tend to equalize the air temperature in the room.

The various aspects of the present invention will be more fully understood when the following portions of the specification are read in conjunction with the accompanying drawings wherein:

BRIEF DESCRIPTION OF THE DRAWINGS

FIG. 1 is a side elevational view of the air temperature equalizing column of the present invention mounted on a floor with its uppermost portion spaced from the ceiling of a room;

FIG. 2 is a top plan view taken substantially in the direction of arrows 2—2 of FIG. 1;

FIG. 3 is a bottom plan view taken substantially in the direction of arrows 3—3 of FIG. 1;

FIG. 4 is an enlarged fragmentary cross sectional view taken substantially along line 4—4 of FIG. 2;

FIG. 5 is an enlarged fragmentary cross sectional view taken substantially along line 5—5 of FIG. 3 and showing the details of the levelers;

FIG. 6 is a fragmentary side elevational view, partially in cross section, showing another embodiment of the present invention wherein the decorative air temperature equalizing column is used in conjunction with a dropped ceiling;

FIG. 7 is a side elevational view of still another embodiment of the present invention having fastening members for positively attaching the column to either the floor of a room or to the wall thereof;

FIG. 8 is a view showing the fastening members taken substantially in the direction of arrows 8—8 of FIG. 7;

FIG. 9 is a fragmentary front elevational view of another embodiment of the present invention wherein the air temperature equalizing column has an open side which is placed flush against the room wall; and FIG. 10 is a fragmentary cross sectional view taken substantially along line 10—10 of FIG. 9.

DESCRIPTION OF THE PREFERRED EMBODIMENTS

The free-standing decorative air temperature equalizing column 10 of FIGS. 1-5 includes a central column portion 11 of octagonal cross section consisting of panels 12 which are suitably secured to each other, as by gluing or suitable brackets at mitered edges 13.

A cap 14 is suitably attached to the upper end of column portion 11, and a base 15 is suitably mounted at the lower end of column portion 11. Relative to cap 14, a plurality of blocks 17 are suitably secured, as by gluing or in any other suitable manner, to the upper ends 19 of four of the panels 12. Angle brackets 20 have their horizontal legs screwed into the tops of blocks 17 and their vertical legs screwed into four of the sides 21 of octagonal cap 14. Octagonal cap 14, which has a plurality of panels 21 suitably secured to each other at mitered edges, as by gluing, also mounts decorative moldings 22, 23, 24 and 25 around its entire periphery.

The lower end of column portion 11 extends into base 15 and is suitably secured to panels 27 by blocks 29 which are secured to each other at mitered ends 28. The attachment between panels 12 and blocks 29 and panels 27 of the base may be by gluing, screws or in any other suitable manner. Octagonal moldings 30, 31 and 32 are suitably secured on the outside of base 15 around its entire periphery. The lower portion of base 15, below lowermost molding 32, consists of spaced four blocks 33 which are suitably secured to panels 27, as by screws or gluing, with four equidistantly spaced open spaces 34 therebetween. A pair of leveling feet 35 are suitably mounted in each block 33 for leveling column 10. Each leveling foot includes a threaded shank 37 which fits into a tapped sleeve 39 secured within block 33. A foot 40 at the end of each shank 37 is intended to bear on floor 41. Thus, by suitably securing shanks 37 into and out of sleeves 39, the feet 40 can be adjusted to bear on floor 41 to maintain column 10 in a perfectly vertical stable position, notwithstanding that the floor 41 may be uneven.

A fan 42 is mounted in the upper portion of columnar member 10. More specifically, a cylindrical housing or cowling 43 is suitably secured to blocks 44 and panels 12 by screws 45 which extend through blocks 44 into panels 12. An U-shaped bracket 47 has its lower leg portions suitably attached to cowling 43, as by welding, and a motor 49 is secured to bracket 47 by screws 50. Motor 49 drives fan blade 51.

The decorative air temperature equalizing column of FIGS. 1-5 is intended to be positioned in a room, in a free-standing manner, that is in a non-loadbearing capacity, with its uppermost portion spaced a distance X from ceiling 52. This distance should be at least 8 inches. A suitable electric cord 46, which is attached to electric motor 49, extends downwardly into the inside of column portion 11 to an on-off variable speed switch 48, and cord 58 passes from switch 48 out through the side of base 15 for plugging into a suitable electrical outlet.

In operation, when fan 42 is energized, it will draw air into the top of columnar member 10, as depicted by arrows 53, and the air flow will continue downwardly through column portion 11, as depicted by arrows 54, and out through the spaces 34, as depicted by arrows 55. Thus, warm air from the upper portion of a room will be forced downwardly through the columnar member 10 and out through spaces 34 to thereby circulate the relatively warm air from the upper portion of the room to the lower portion of the room and thus overcome the stratification which normally occurs. In this embodiment there are no grilles because air enters the open top of the column and leaves from the spaces 34 between blocks 33, which are essentially the feet of the column.

The embodiment of FIGS. 1-5 was intended for use in a room having a normal permanent ceiling. However, the embodiment of FIG. 6 is intended for use in a room having a dropped ceiling 57 supported by wires 59 from the normal ceiling 52'. The decorative air temperature equalizing column 10' of FIG. 6 may be identical in all respects to the embodiment of FIGS. 1-5 except that the cowling 43 of fan 42 is extended to form a cylndrical extension 60 having end 61 for sucking in air in the direction of arrows 62 from the space between dropped ceiling 57 and normal ceiling 52'. Thus, warm air which stagnates into the space above dropped ceiling 57 can be circulated into the room in the same manner as described above relative to FIGS. 1-5. In the embodiment of FIG. 6, the molding 25 is placed in abutting relationship with the underside 63 of the dropped ceiling 57. It will be appreciated that extension 60 passes through a suitable hole in the dropped ceiling.

In FIGS. 7 and 8 a further modified embodiment of the present invention is disclosed. The decorative air temperature equalizing column 10'' may be identical in all respects to the embodiment of FIGS. 1-5 except as noted hereafter. In this respect, a U-shaped bracket 65 may be utilized to secure the columnar portion 11 to a wall 67 to stabilize it. Alternatively, angle brackets 69 may have their vertical legs 70 secured to blocks 33 by screws 71 and their horizontal legs may be secured to floor 41 by screws 72. Thus, either angle brackets 69 or brackets 65, or both, can be used to positively affix the columnar member 10'' to a suitable portion of the room.

In FIGS. 9 and 10 a still further embodiment of the present invention is disclosed. The decorative air temperature equalizing column **10*a* is actually only a portion of a column which has five panels 75 which correspond to five of the panels 12 of FIGS. 1-5. There is an open space 77 between the two outermost panels 75. A partial cap 79 is suitably mounted at the upper end of panel 75, and a partial base 80 is suitably mounted at the lower end of panels 75. The columnar member 10*a*is intended to be placed against wall 82** and suitably held in position by brackets (not shown) or in any other suitable manner.

A fan 83 is mounted within the upper portion of columnar member **10*a* in the same way as discussed above relative to FIGS. 1-5. Broadly, cowling 84, which corresponds to cowling 43, is secured to certain of the panels 75 by screws which extend through blocks 85. The cap 79 and base 80 are secured to panel 75 in a manner analogous to the way cap 14 and base 15 are secured in FIGS. 1-5. A plurality of inlet grilles 87 are located in cap 79 and a plurality of outlet grilles 89 are located in base 80. However, if desired, only one inlet and one outlet grille can be used. As can be seen, the open side of columnar member 10*a* fits flush against wall 82 so that the surface 90 of wall 82 acts as a closing side for columnar member 10*a*. In operation, when fan 83 is energized, air will flow into inlet grilles 87, through the space between panels 75 and wall surface 90, and out through outlet grills 89** to thereby tend to equalize the temperature of air in the room.

While columns of a specific shape have been disclosed, it will be appreciated that they can take any desired decorative configuration and need not be octagonal, as shown in FIGS. 1-8, nor need they be partially octagonal, as shown in FIGS. 9 and 10. The columns may be round, hexagonal, pentagonal, or in any other desired shape. Furthermore, it will be appreciated that the decorative air temperature equalizing columns may be load-bearing, that is, their upper ends may abut the ceiling and their lower ends may rest on the floor. In an embodiment of the foregoing type, the air inlets and outlets may be in the nature of grilles, as shown in FIG. 9. In addition, it will be appreciated that the features of any of the embodiments may be incorporated into any other of the embodiments where applicable. Furthermore, the column can be fabricated out of any suitable material, such as wood, composition board, metal, plastic or any other material which is rigid.

While preferred embodiments of the present invention have been disclosed, it will be appreciated that the present invention is not limited thereto, but may be otherwise embodied within the scope of the following claims.

What is claimed is:

1. A free-standing air temperature equalizing column for placement in a room having a floor, walls and a ceiling for circulating air from the upper portion of the room to the lower portion thereof comprising a hollow columnar member, an upper column portion in said columnar member terminating at an uppermost portion, a lower column portion in said columnar member terminating at a base having a lowermost base portion, said lowermost base portion being of a width which will permit said columnar member to assume a free-standing position on said floor without additional support, a plurality of spaced leveling means extending below said lowermost base portion for bearing against said floor to level said columnar member, said hollow columnar member being of a height wherein said uppermost portion is spaced from said ceiling when said lowermost base portion rests on said floor, air inlet means in said upper column portion, air outlet means in said lower column portion, and air moving means in said columnar member for causing flow of air from said upper portion of said room into said air inlet means and through said columnar member and out of said air outlet means into said lower portion of said room to thereby tend to equalize the air temperature in the room.

2. An air temperature equalizing column as set forth in claim 1 wherein said air inlet means comprises an open top of said columnar member.

3. An air temperature equalizing column as set forth in claim 1 wherein said columnar member has a side, and wherein said air inlet means comprises an opening in said side.

4. An air temperature equalizing column as set forth in claim 1 wherein said columnar member has a side, and wherein said air outlet means is located in said side.

5. An air temperature equalizing column as set forth in claim 4 wherein said air outlet means comprises a plurality of outlets.

6. An air temperature equalizing column as set forth in claim 1 including means for securing said lower column portion to said floor.

7. An air temperature equalizing column for placement in a room and circulating air from the upper portion of the room to the lower portion thereof comprising a hollow columnar member, an upper column portion in said columnar member, a lower column portion in said columnar member, air inlet means in said upper column portion, air outlet means in said lower column portion, and air moving means in said columnar member for causing flow of air from said upper portion of said room into said air inlet means and through said columnar member and out of said air outlet means into said lower portion of said room to thereby tend to equalize the air temperature in the room, said room having a dropped ceiling with an air space above the dropped ceiling, and said upper column portion extending through said dropped ceiling to permit said air inlet means to receive air from said air space.

8. An air temperature equalizing column as set forth in claim 7 wherein said room has a floor, and leveling means on said lower column portion for leveling said columnar member relative to said floor.

9. An air temperature equalizing column for placement in a room and circulating air from the upper portion of the room to the lower portion thereof comprising a hollow columnar member, an upper column portion in said columnar member, a lower column portion in said columnar member, air inlet means in said upper column portion, air outlet means in said lower column portion, and air moving means in said columnar member for causing flow of air from said upper portion of said room into said air inlet means and through said columnar member and out of said air outlet means into said lower portion of said room to thereby tend to equalize the air temperature in the room, said room having a wall, and said columnar member including an open side for placement against said wall to cause said wall to close off said open side, and securing means for securing said open side in substantially sealed relationship with said wall, said room having a dropped ceiling with an air space above said dropped ceiling, and said air inlet means being in said air space.

10. A free-standing air temperature equalizing column as set forth in claim 1 wherein said lowermost base portion includes a plurality of spaced blocks, and wherein said air outlet means comprise spaces between said plurality of spaced blocks.

11. A free-standing air temperature equalizing column as set forth in claim 10 wherein said leveling means extend downwardly from said spaced blocks and second spaces between said leveling means.

12. A free-standing air temperature equalizing column as set forth in claim 11 wherein said air outlet means additionally comprise said second spaces between said leveling means to thereby cause the flow of air out of said air outlet means to be substantially around the entire portion of said lowermost base portion.

13. A free-standing air temperature equalizing column as set forth in claim 7 wherein said room has a floor including a plurality of spaced blocks on said lower column portion for positioning immediately adjacent said floor, and wherein said air outlet means comprise spaces between said spaced blocks.

14. A free-standing air temperature equalizing column as set forth in claim 13 including spaced leveling means extending downwardly from said spaced blocks for bearing on said floor for leveling said columnar member.

15. A free-standing air temperature equalizing column as set forth in claim 14 including second spaces between said spaced leveling means, and wherein said air outlet means comprise said spaces and said second spaces.

16. A free-standing air temperature equalizing column as set forth in claim 11 wherein said leveling means comprise two levelers on each block, and wherein said second spaces include spaces between said two levelers on each of said blocks.

* * * * *